US009615642B2

(12) United States Patent
Bergh et al.

(10) Patent No.: US 9,615,642 B2
(45) Date of Patent: Apr. 11, 2017

(54) ARTICULATING MULTI-ADJUSTABLE DIVIDER SYSTEM

(75) Inventors: James Bergh, Boulder, CO (US); Eric Michael Onno Bergman, Playa Vista, CA (US); Thi Phuong-Nam Bagley, San Francisco, CA (US)

(73) Assignee: Thule Organization Solutions, Inc., Longmont, CO (US)

( * ) Notice: Subject to any disclaimer, the term of this patent is extended or adjusted under 35 U.S.C. 154(b) by 573 days.

(21) Appl. No.: 14/116,250

(22) PCT Filed: May 10, 2012

(86) PCT No.: PCT/US2012/037357

§ 371 (c)(1),
(2), (4) Date: Feb. 14, 2014

(87) PCT Pub. No.: WO2012/154978

PCT Pub. Date: Nov. 15, 2012

(65) Prior Publication Data

US 2014/0326560 A1 Nov. 6, 2014

Related U.S. Application Data

(60) Provisional application No. 61/484,499, filed on May 10, 2011.

(51) Int. Cl.
*A45C 13/02* (2006.01)
*A45C 11/38* (2006.01)

(52) U.S. Cl.
CPC ..... *A45C 13/02* (2013.01); *A45C 11/38* (2013.01); *A45C 2013/026* (2013.01)

(58) Field of Classification Search
CPC .. A45C 13/02; A45C 3/00; A45C 5/00; A45C 3/02; A45C 3/004
USPC ..... 190/100, 109, 110, 11, 112, 113, 121, 190/125; 206/316.2, 522, 223, 287, 292, 206/315.11, 315.3, 316.1, 426, 541, 579;
(Continued)

(56) References Cited

U.S. PATENT DOCUMENTS

| | | | |
|---|---|---|---|
| 3,381,782 | A | 5/1968 | Ikelheimer |
| 3,870,132 | A | 3/1975 | Hanley |
| 4,212,377 | A | 7/1980 | Weinreb |

(Continued)

FOREIGN PATENT DOCUMENTS

| | | |
|---|---|---|
| DE | 1916934 | 6/1965 |
| DE | 7615879 | 10/1976 |

(Continued)

OTHER PUBLICATIONS

International Search Report and Written Opinion for International (PCT) Patent Application No. PCT/US2012/037357, mailed Sep. 10, 2012 12 pages.

(Continued)

*Primary Examiner* — Anthony Stashick
*Assistant Examiner* — Cynthia Collado
(74) *Attorney, Agent, or Firm* — Sheridan Ross P.C.

(57) ABSTRACT

An apparatus adapted for use within a luggage item is described which comprises features for conforming to and surrounding one or more objects of various sizes and shapes. The apparatus, which may be removable, further includes features for protecting items from damage due to impact, abrasion, contamination, and other undesired effects.

11 Claims, 9 Drawing Sheets

(58) Field of Classification Search
USPC ..... 220/529, 552; 229/120.02, 120.07, 229/120.22, 198
See application file for complete search history.

(56) References Cited

U.S. PATENT DOCUMENTS

| | | | | |
|---|---|---|---|---|
| 4,790,460 | A * | 12/1988 | Harper, Jr. | A45F 3/08 224/250 |
| 5,356,004 | A | 10/1994 | Weinreb | |
| 5,769,221 | A | 6/1998 | Cyr | |
| 6,640,944 | B2 | 11/2003 | Adams | |
| 2004/0149618 | A1* | 8/2004 | Otaki | B65D 81/052 206/521 |
| 2004/0188203 | A1 | 9/2004 | Gold et al. | |
| 2006/0118440 | A1* | 6/2006 | Shiao | A63B 55/00 206/315.6 |
| 2008/0115332 | A1 | 5/2008 | Kopp | |
| 2009/0250362 | A1 | 10/2009 | Melmon et al. | |
| 2010/0071814 | A1 | 3/2010 | Crandall | |
| 2010/0219090 | A1 | 9/2010 | Thatcher et al. | |

FOREIGN PATENT DOCUMENTS

| | | |
|---|---|---|
| DE | 29510891 | 10/1996 |
| JP | 2005-137523 | 6/2005 |

OTHER PUBLICATIONS

International Preliminary Report on Patentability for International (PCT) Patent Application No. PCT/US2012/037357, mailed Nov. 21, 2013 8 pages.

* cited by examiner

ARTICULATING MULTI-ADJUSTABLE DIVIDER SYSTEM

CROSS REFERENCE TO RELATED APPLICATION

This application is a national stage application under 35 U.S.C. 371 of PCT Application No. PCT/US2012/037357 having an international filing date of May 10, 2012, which designated the United States, which PCT application claimed the benefit of U.S. Application Ser. No. 61/484,499, filed May 10, 2011, both of which are incorporated by reference in their entirety.

FIELD OF THE INVENTION

The present invention relates generally to a luggage apparatus and adjustable mechanism capable of securely accommodating a variety of items positioned within the interior of the luggage apparatus or case. More specifically, the present invention relates to an articulating insert that may be optionally employed, positioned, and shaped within a photo or video bag or other storage case to secure and protect a variety of contents including, but not limited to, electronic, photo and video equipment.

BACKGROUND OF THE INVENTION

Camera bags and cases are generally available in a wide range of sizes, layouts, and materials. Professional and amateur photographers alike require fast and convenient access to various contents stored within a camera bag, yet also desire a high level of protection for these contents from external impact, collisions of items within the bag, and displacement of the contents generally. Protection of contents from contamination, such as contamination due to precipitation, dust, sand, and dirt is also desired. Furthermore, convenience, portability, mobility, and versatility are also coveted features for various types of bags. These concerns and needs are not limited to camera bags and cases, but are applicable to bags and luggage generally, where fragile items are retained.

It is currently known in the art to provide luggage and camera bags designed to prohibit or limit movement of items carried within. It is known to use Velcro in certain luggage applications. However, the application, removal, and/or general use of Velcro creates a significant amount of noise and is undesirable in, for example, wildlife photography applications. As used herein, the term "luggage" relates generally, but is not limited to backpacks, duffles, suitcases, camera bags, and other storage devices. Various currently known devices, however, generally fail to accommodate a wide or changing array of shapes and objects. Furthermore, these devices fail to provide an apparatus which provides the user with the ability to conform at least a portion of an interior support mechanism in a bag or case to specific, and perhaps amorphous or irregular objects.

U.S. Patent Application Publication No. 2009/0250362 to Melmon et al. ("Melmon") discloses bags and cases for storage of cameras and other objects and is incorporated herein by reference in its entirety. Melmon discloses a waterproof portion adapted for use with a compartmentalized inner structure, yet fails to teach or describe a dynamic system wherein various different sized objects may be selectively secured within the bag.

U.S. Patent Application Publication No. 2004/0188203 to Gold et al., which is incorporated herein by reference in its entirety, discloses a protective and non-protective carrying device for various items. Gold et al., however, fails to disclose various novel features of the present invention, including a user adjustable device which may quickly and easily conform to, secure, and protect contents of the bag.

U.S. Pat. No. 4,212,377 to Weinreb discloses a convertible bag and is incorporated herein by reference in its entirety. Weinreb discloses an adaptable pouch of a parallelopipedal shape further comprising an elongated divider panel which is swingably secured within the pouch. Weinreb, however, fails to disclose various novel features of the present invention, including, but not limited to, an articulating adjustable divider element for conforming to and securing a variety and/or plurality of items.

U.S. Pat. No. 5,356,004 to Weinreb, which is hereby incorporated herein by reference in its entirety, discloses a camera bag divider system comprising dividers which divide the case into multiple and variable compartments. Weinreb fails to disclose various novel features and aspects of the present invention, including, but not limited to, a dynamic articulating insert which may selectively conform to a variety and/or plurality of objects and which may further be removed from a piece of luggage and/or inserted into another device.

U.S. Pat. No. 6,640,944 to Adams, which is incorporated herein by reference in its entirety, discloses a rigid and collapsible divider for portable receptacles. Adams discloses a device comprising hinged planar portions, and fails to disclose various novel features and aspects of the present invention. For example, Adams fails to disclose a device which may accommodate and protect a variety of objects, including non-rectilinear objects.

U.S. Pat. No. 3,870,132 to Hanley, which is incorporated herein by reference in its entirety, discloses a travel bag with various compartments provided therein. Hanley discloses a travel bag with compartments specifically designed and adapted for particular objects and thus fails to disclose a device whereby portions or features of the bag are capable of conforming and intimately securing a wide array of objects and/or various different collections of items to be stowed or carried.

Therefore, there has been a long-felt and unmet need to provide an adjustable divider system for use within a luggage device. There has further been a long-felt and unmet need to provide such a system which is capable of being quickly and easily adjusted, loosened, tightened, and/or otherwise conforming to any number of items which may be placed within a luggage device, and/or removable in another embodiment to be placed independently within a luggage device.

SUMMARY OF THE INVENTION

It is thus one aspect of the present invention to provide a protective articulating device capable of securing, organizing, and protecting luggage items which are fragile such as electronic devices, cameras, and video equipment. In one embodiment, the present invention comprises an articulating insert which is capable of being selectively secured in a variety of positions and orientations for protecting and securing objects stored within a luggage item.

It is another aspect of the present invention to provide an articulating insert with a plurality of grooves or slots adapted to receive a transitioning member. For example, in one embodiment, a device is provided with slots or receiving members at either regular or irregular distances intervals wherein the receiving members are adapted to be clasped or engaged by retaining members, such as elastic devices. Thus, an articulating insert of the present invention may be positioned in a ratchet-like manner. One of skill in the art will recognize that the articulating insert of the present invention is movable in a variety of directions. Thus, as used herein, ratchet does not necessarily refer to the insert being movable in only a single linear or rotational direction. Rather, in one embodiment, the device may be slid or translated in at least two linear directions and the receiving portions capable of securing or immobilizing the insert at various intervals.

In an alternative embodiment, the articulating insert of the present invention is adapted to provide greater resistance to force and/or movement in one direction and is generally slidable or translatable in an opposite direction. For example, in one embodiment, an articulating insert is provided which comprises segments with an asymmetric profile, such as that resembling fish scales or asymmetrical saw teeth. Thus, movement is generally inhibited or prohibited in one direction, while the insert is allowed to slide or translate through retaining members in a generally opposite direction.

It is another aspect of the present invention to provide a protective articulating insert that is easily adjustable to a variety of shapes. Thus, in one embodiment, the present invention comprises pull tabs, extensions, or cords which allow a user to cinch, pull, tighten or otherwise quickly conform an articulating insert to various luggage contents.

It is yet another aspect of the present invention to provide an articulating insert which may be selectively removed from a luggage device and disposed within additional luggage devices or similar objects. In one embodiment, the present invention comprises an insert that is selectively removable. In one embodiment, an articulating insert is provided that is removably connected to a portion of the luggage item, such as through the use of Velcro, snaps, zippers, straps, and/or various other similar items. In an alternative embodiment, the articulating insert of the present invention is secured solely by the securing members adapted for holding and shaping various portions of the insert as will be described herein.

It is yet another aspect of the present invention to provide an articulating insert with advantageous properties such as impact/force absorption, non-abrasiveness, and/or non-slip properties. Thus, in one embodiment, a multi-layered insert is provided wherein the interior layer of the insert is comprised of foam, such as ethylene-vinyl acetate ("EVA") foam or various other similar products known to absorb and/or cushion impact.

It is yet another aspect of the present invention to provide a protective and/or adjustable insert which does not utilize or require Velcro and thus produces minimal noise when adjusted. Thus, in one embodiment, the present invention is adapted for and/or useful in applications where noisy movements are unfavourable, such as wildlife photography and hunting.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

Figure 1:
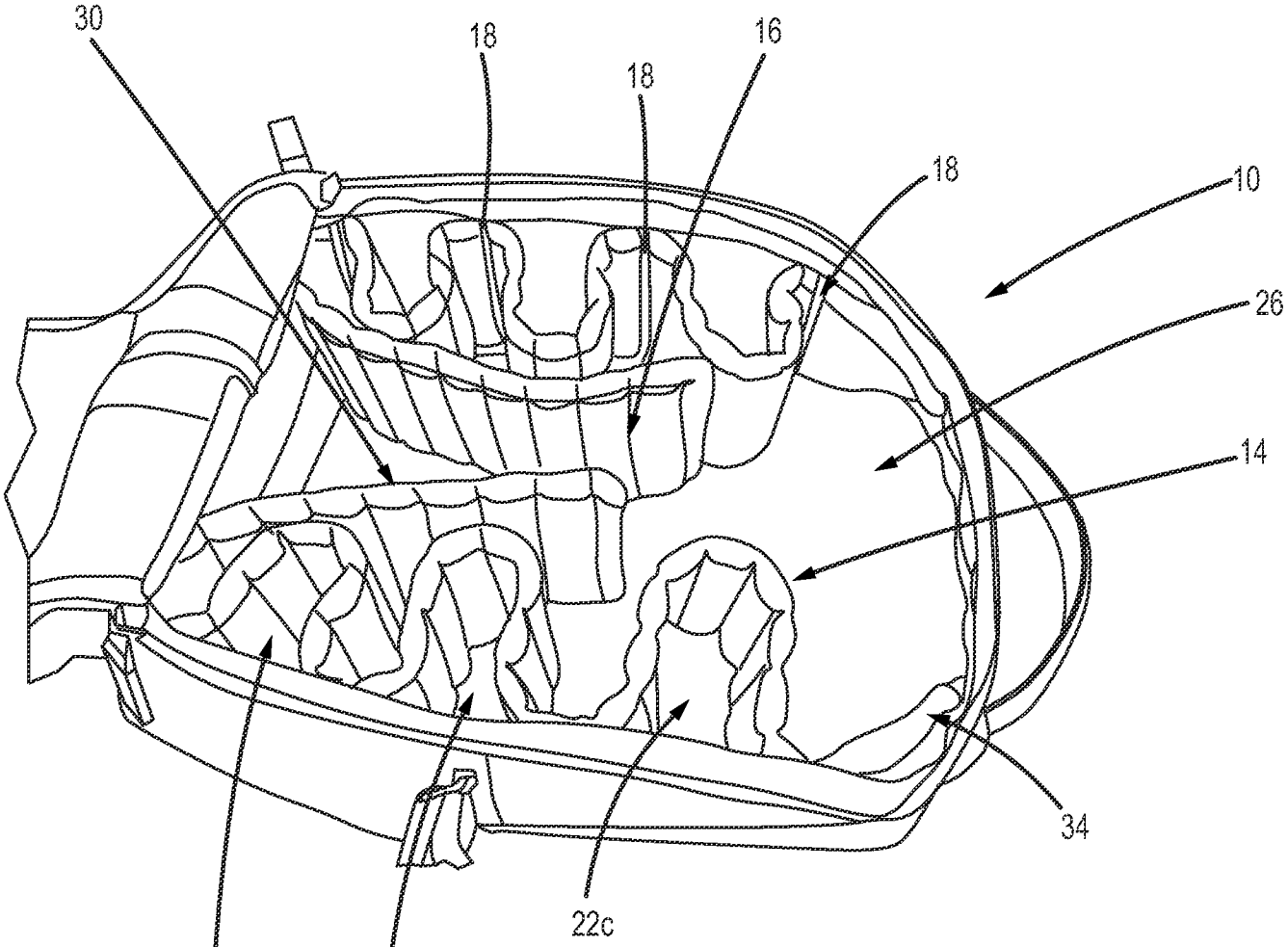
FIG. 1 is a perspective of one embodiment of the present invention.

To assist in the understanding of the present invention the following list of components and associated numbering found in the drawings is provided herein:

| Component | # |
|---|---|
| Luggage Item | 10 |
| Articulating Insert | 14 |
| Tension applying means | 15 |
| Seams/Receiving Members | 16 |
| Retaining Members | 18 |
| Adjustable Compartments | 22 |
| Internal Volume | 26 |
| Articulating Segments | 30 |
| Insert Terminus | 34 |
| Outer Layer | 36 |
| Internal Portion | 38 |
| Cradle | 50 |
| Directional Arrow | 100 |

It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

DETAILED DESCRIPTION

As shown in FIG. 1, a luggage item 10 is provided within an articulating adjustable insert 14 disposed therein. Luggage item 10, as shown in FIG. 1, is a portable camera and/or video device carrying case adapted for use as a backpack, shoulder bag or tote bag. However, one of ordinary skill in the art will recognize that the present invention is not limited to any particular type or size of luggage item. Indeed, it is contemplated that the articulating insert of the present invention may be used in a variety of ways and disposed within a variety of luggage and non-luggage items. Luggage items of the present invention which may utilize or comprise an articulating insert 14 include, but are not limited to, camera bags, backpacks, laptop cases, luggage, briefcases, attaché cases, duffles, golf bags, sport bags, and various device specific bags such as those designed to accommodate specific electronic and other sensitive or fragile devices. As shown in FIG. 1, luggage item 10 comprises an internal volume 26, articulating protective insert 14, and retaining members 18, which comprise elastic in various embodiments, capable of interacting with the articulating insert 14. The dynamic, multi-adjustable articulating insert 14 of the present invention is generally comprised of a plurality of sections 30 that are capable of bending or folding with respect to one another and held together and spaced apart by seams 16. Retaining members 18 are provided to hold or restrain certain portions of the articulating member 14 in a preferred position and provide a user with the option of creating a plurality and/or variety of different compartments 22(*a*), 22(*b*), 22(*c*) which securely retain one or more objects in a preferred position. Retaining members 18, in various embodiments, are provided as elastic members which may be selectively expandable by a user. Members of such embodiments comprise, for example, spandex or similar material to provide an elastic force. In alternative embodiments, one or more retaining members are provided that are substantially inelastic. For example, in one embodiment, one or more substantially inelastic nylon cords are provided, the cords being selectively securable and useful for securing a divider system 14.

In one embodiment, retaining members 18 are comprised of a material with a sufficiently high resiliency or spring force to hold the articulating member 14 in a desired location and/or position. However, members 18 allow for the translation of an articulating member 14 between a retaining member 18 and a side wall or portion of the internal volume 26 of a luggage item 10 when a user applies force to the articulating member 14 or a combination of the elastic member 18 and the articulating member 14. Therefore, for example, portions 22(*a*), 22(*b*), 22(*c*) may be selectively formed. A user may then apply tension to a portion of the articulating member 14 in order to cinch or tighten the articulating member 14 around objects disposed within areas 22(*a*), 22(*b*) and 22(*c*) and securely maintain the items. In one embodiment, at least one end of the articulating member 14 is securely fixed to a portion of the luggage item 10. For example, the articulating member 14 may be stitched, riveted, Velcro-ed, glued, zippered, or otherwise affixed at one end 34 of the articulating member 14. In various embodiments, the articulating member 14 may be completely removed from an internal area 26 of a luggage item 10. Thus, portions of the articulating member which are attached to a portion of a luggage item 10 may be selectively removable (e.g. through the use of a variety of known devices and materials such as snaps, Velcro, zippers, etc.)

In one embodiment, the articulating insert 14 of the present invention is designed to house, contain, and/or secure items for transport, such as when the luggage item 10 is carried or disposed on a user during walking, running, cycling, and/or when the luggage item 10 is transported independently from a user. Thus, the present disclosure contemplates an articulating insert 14 and retaining members 18 which are capable of securing items with an appropriate amount of tension and/or friction to substantially prevent or limit the ability of a luggage item to become dislodged from the compartments 22*a*, 22*b*, 22*c*. In one embodiment, members are retained by high elastic modulus retaining members 18 which are adapted to be stretched and/or deformed by a user. Stretching or deforming retaining members 18 allows a user to adjust the shape and/or size of a compartment, yet provides sufficient force to prevent undesired expansion or deformation. Undesired expansion or deformation may comprise, for example, changes in shape due to forces applied to the compartment from changes in the orientation of the luggage item 10 and resulting changes in the orientation and gravitational forces/effects of items housed within compartments.

In an alternative embodiment, retaining members 18 comprise means for securing or maintaining a desired tension. For example, in one embodiment, retaining members 18 are threadable through a portion of the luggage item 10 and comprise tension maintaining devices which allow for one or more retaining members to be secured at a user-applied tension. Tension maintaining devices of the present invention may include, for example, spring loaded clips, alligator clips, ladderlock buckles, cord locks, spring loaded cord locks, cord stops, locking wheels, and similar devices.

Figure 2A:
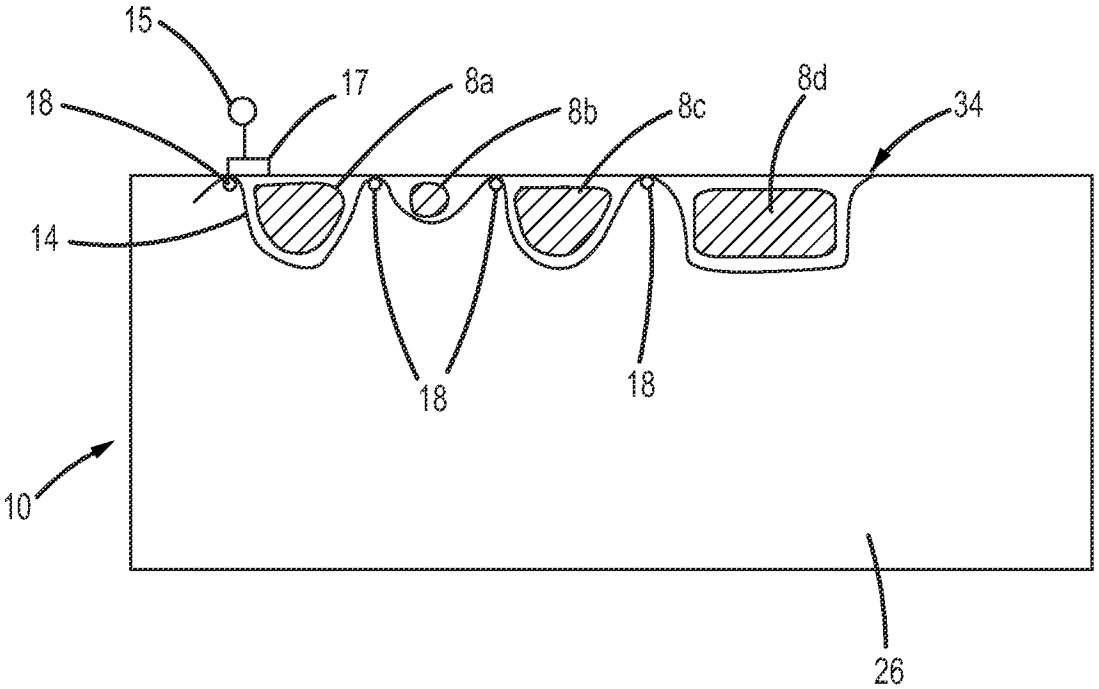
FIG. 2 is a top view of a luggage item according to one embodiment of the present invention.

FIG. 2*a* is a top view of an internal volume 26 of a luggage item 10 with various components disposed therein, including an articulating insert 14. FIG. 2*a* depicts one embodiment of the present invention wherein retaining members 18 comprise tension applying means 15 for selectively applying tension to a retaining member 18 and a tension maintaining device 17 to maintain or secure tension applied by a user. In one embodiment, tension applying means 15 includes a ball, handle, loop, ring, hook, hook and loop material, or other similar device disposed at a distal portion and adapted for gripping by a user. Tension retaining means 17 may be comprised of, by way of example only, a known cord lock which allows for relatively unobstructed translation of a portion of the retaining member 18 through the cord lock when a spring disposed with the cord lock is compressed. Similarly, the cord lock or similar device is capable of maintaining tension applied to a retaining member 18 when the spring is released. Thus, in one embodiment of the present invention, contents may be secured within a luggage item 10 by placing contents 8*a*, 8*b*, 8*c*, 8*d* within an area defined by an un-tensioned articulating insert 14, deactivating the tension maintaining device 17, applying tension via the tension applying means 15, and activating the tension maintaining device 17 once the insert 14 is in a desired position and/or state of tension.

Although FIG. 2*a* depicts only one retaining member 18 with tension applying means 15 and tension maintaining means 17, one of skill in the art will recognize that any number of retaining members 18 may be equipped with these features. Indeed, the present invention contemplates as few as zero retaining members 18 comprising such features and as many as all of the provided retaining members 18 comprising these or similar features. Furthermore, one of ordinary skill in the art will recognize that tension applying 15 and retaining 17 means may be utilized regardless of the material selected for retaining members 18. For example, tension applying and retaining means 15, 17 may be utilized regardless of whether the retaining members 18 are composed of elastic, nylon, polyester, leather, rubber, etc.

FIG. 2*a* depicts an embodiment wherein at least one end of an articulating member 14 is anchored or secured to a portion 34 of the luggage item 10. One of skill in the art will recognize that tension applying means 15 and tension retaining means 17 may be utilized in various embodiments, including those which do not comprise one end of the member 14 being secured to a portion of the luggage item 10.

Figure 2B:
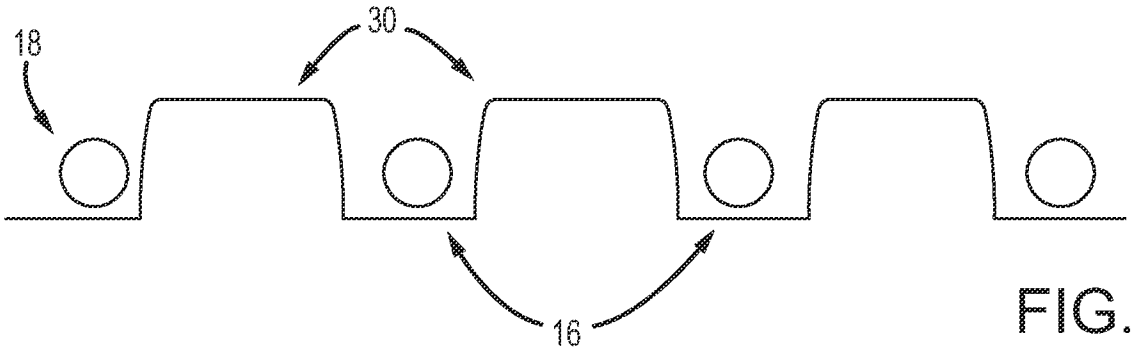

FIG. 2*b* is a cross-sectional plan view of one embodiment of the present disclosure wherein an articulating member is secured by one or more retaining members 18. As shown, seams or receiving portions 16 are be provided within an articulating insert which are adapted to engage and/or be secured by a retaining member 18. For example, retaining members 18 may be nested within seams or retaining portions 16 so as to at least temporarily secure an articulating member and/or create a variety of compartments of a user-selected size.

Figure 2C:
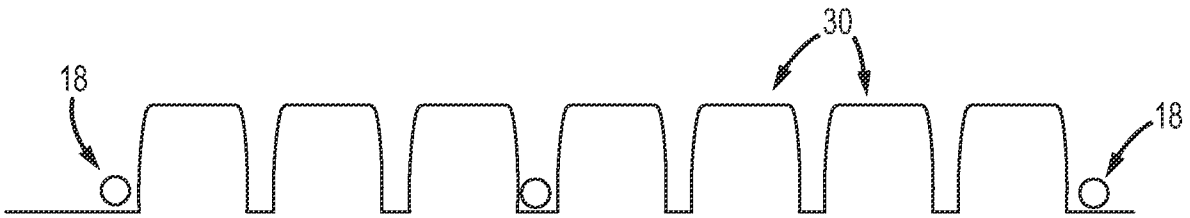

FIG. 2*c* is a cross-sectional plan view of another embodiment, wherein retaining members are provided at generally uneven intervals. One of ordinary skill in the art will recognize that any number of panels 30 may be disposed between retaining members 18. Furthermore, one of ordinary skill in the art will recognize that retaining members 18 of the present disclosure need not be spaced at any specific intervals and need not be spaced at even increments. Although FIGS. 2*b*, 2*c*, and 2*d* depict a plurality of retaining members 18, the present disclosure contemplates providing as few as one retaining member 18 within a luggage item.

Figure 2D:
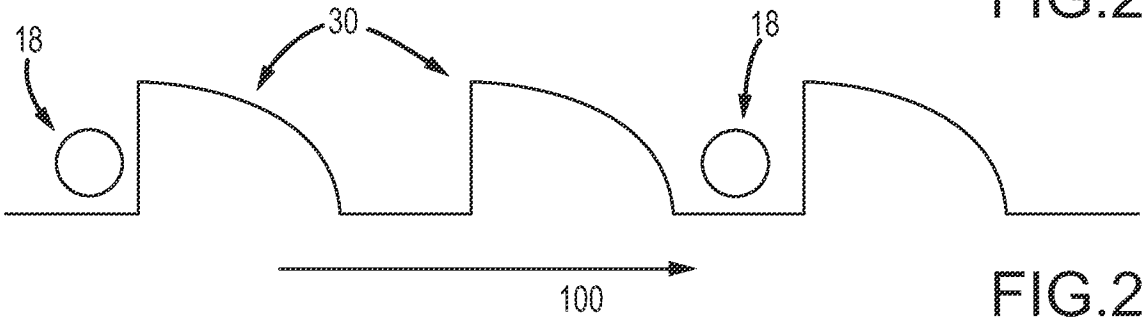

FIG. 2*d* depicts yet another embodiment of the present disclosure wherein one or more panels or sections 30 of an articulating member 14 are asymmetrically shaped about at least one axis so as to facilitate movement in one direction 100 while providing greater resistance in an opposite direction.

As shown in FIGS. 2*b*-2*d*, an articulating insert 14 of the present invention may be ratcheted in at least one direction. That is, embodiments of the present disclosure contemplate transitioning an insert from one user-selected position to another and restraining members 18 restrain portions of the insert at discrete locations 16.

Figure 3:
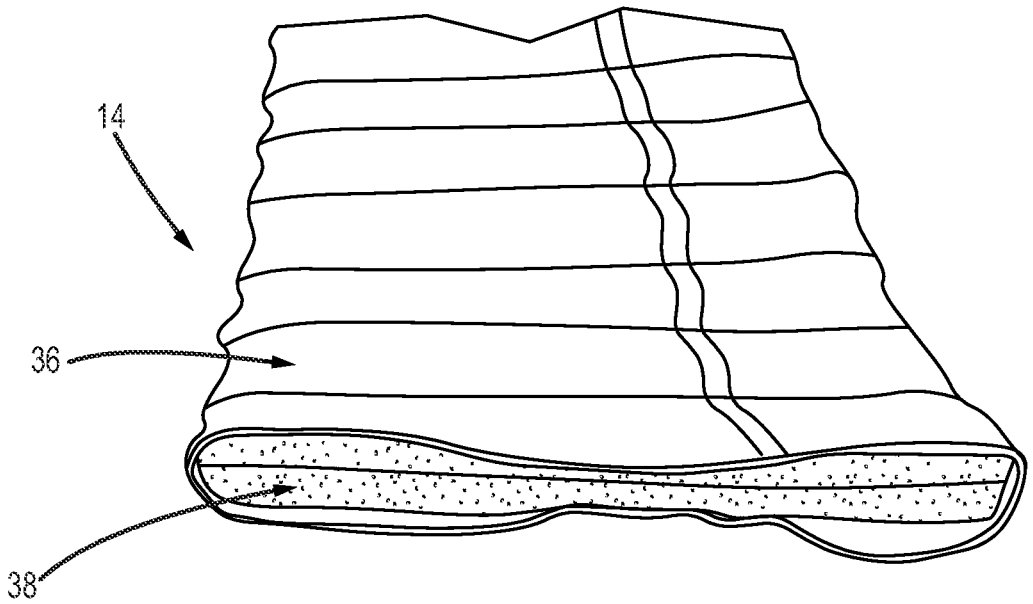
FIG. 3 is a perspective view showing the cross-section of one embodiment of the present invention.

FIG. 3 displays a cross-section of an articulating member 14 of the present disclosure. As shown, the articulating insert 14 comprises a multi-layer construction. In one embodiment, an internal portion 38 of the articulating insert 14 is comprised of ethylene-vinyl acetate ("EVA") and is surrounded at least partially or covered by a fabric layer 36. The present disclosure contemplates the use of a material within the inner portion 38 of the articulating member 14 which is suitable for dampening impact and otherwise protecting items that the insert 14 may house or surround. Thus, one of ordinary skill in the art will recognize a variety of materials including, but not limited to, EVA or open-celled foam which may be used within the articulating insert 14. By way of example only, these materials may be any one of a variety of polymers with elastomeric properties that provide both softness and flexibility. In one embodiment, the EVA foam of the present invention is molded in a manner to allow for varying stiffness along one or more dimensions of the foam structure. In one embodiment, the layered piece 14 of the present invention comprises an additional stiffening plate (not shown) disposed within a thickness of the internal portion 38 of the articulating member 14. Stiffening plates of the present invention may be comprised, by way of example only, steel, titanium, aluminum, plastic, polyethylene, polyether ether ketone, carbon fiber, and other similar materials. In one embodiment, rigid inserts of the present invention are selectively removable and may be removed, for example, through withdrawal of the plate from one or either longitudinal end of a panel 30.

The outer portion or layer 36 of the articulating insert 14 is, in one embodiment, comprised of a soft fabric which poses a reduced risk of scuffing or scratching contents to be secured by the insert 14. Various materials which may be utilized for this portion 36 include, but are not limited to, cottons, polyester, silk, velvet, and various blends made therefrom. In one embodiment, the outer layer 36 of the articulating member 14 further comprises gripping means including, but not limited to, elements having a higher co-efficient of friction (i.e. relative to a remainder of the outer layer 36) disposed on at least portions of the outer layer 36. For example, rubber protrusions or patches may be disposed on an outer layer 36 to reduce the risk of slippage, displacement, or loss of items disposed within an articulating insert 14.

In one embodiment, an articulating insert 14 of the present disclosure is comprised of a soft material, such as a soft fabric, textile, or polymer which prevents abrasion of items to be stored and/or reduces or eliminates noise associated with removing and inserting items. In an alternative embodiment, selective portions of the articulating insert 14 are comprised of a soft material so as to reduce the risk of abrasion of certain portions of items (e.g. lenses), and/or reduce noise associated with the removal and insertion of items. For example, a portion of the insert 14 that is more prone to contact items to be stored is comprised of a soft material as described herein, while the remainder of the insert 14 may be comprised of various other materials. In yet another embodiment, at least portions of the articulating insert 14 comprise water-proof or water resistant materials to aid in the protection of items to be stored within compartments 22 or a main volume 26 from water damage.

It will be recognized by one of skill in the art that contents may be subject to moisture/water from a variety of locations and/or means. For example, items to be stored within a luggage item 10 may be contacted by water that has been stored/leaked from additional items stored within the luggage item 10, by water that has been stored/leaked from items stored external to the luggage item 10, by water entering the luggage item 10 when the luggage item 10 has been left at least partially open, by condensation, and various other means. Thus, embodiments of the present disclosure contemplate the utilization of water-protective materials to help protect items to be stored.

In one embodiment, an outer portion 36 of an articulating insert 14 comprises Velcro features which allow for the insert 14 to be attached to itself and/or various portions of an internal volume of a luggage item. For example, an outer portion 36 may include Velcro patches or segments or may be entirely comprised of Velcro to allow for the insert 14 to be removably secured to a variety of locations and/or objects. However, it is recognized that various known luggage items, such as camera bags, which rely on Velcro features suffer from the drawbacks of attracting and retaining various unwanted debris. It is known that this collection of debris may be particularly undesirable in luggage items designed to house delicate, fragile, sensitive, and/or valuable items such as lenses, cameras, and various related components. Furthermore, it is known that the application and removal of Velcro generates noise which is undesirable when attempting to take photos of wildlife, for example. Therefore, the present disclosure contemplates at least one embodiment wherein the use of Velcro attachments are minimized or rendered unnecessary through the use of alternative retaining members as shown and described herein.

Figure 4:
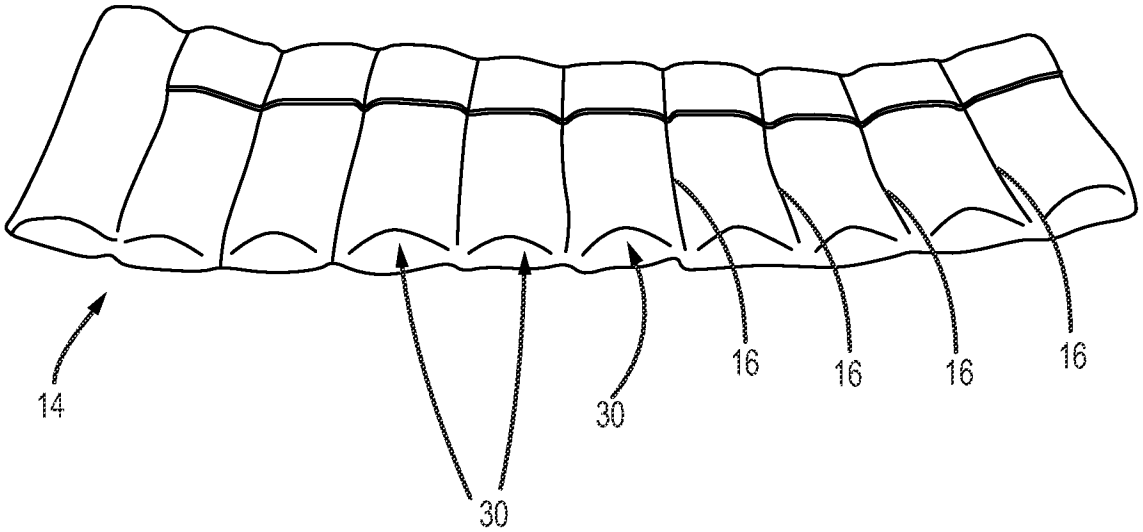
FIG. 4 is a perspective view of one embodiment of the present invention.

Referring now to FIG. 4, an articulating insert 14 of the present disclosure is shown, comprising a plurality of segments or panels 30. In one embodiment, panels may be formed or defined by stitching an outer layer of the articulating insert 14. The panels 30 allow the insert 14 to be conformed to or shaped around an array of different shapes and/or objects. For example, it is known that camera lenses of a wide variety of sizes, shapes, lengths, and/or diameters frequently need to be transported in a luggage item.

The present invention contemplates accommodating a wide variety of such items through the use of an articulating insert 14 with crush proof properties. In one embodiment, the present invention offers the ability to selectively form an array of different sized and shaped stow compartments and thus does not confine a user to discrete and predetermined compartments which may not be suitable for certain objects. For example, the insert 14 may be manually manipulated and threaded through retaining members 18 until one or more compartments of desired dimensions are created. Compartments may be formed around objects to be housed, or may be pre-formed and allowed to receive luggage contents. One of skill in the art will recognize that the size and number of compartments that may be formed is limited only by the length of the insert 14 provided. Therefore, one embodiment of the present invention contemplates providing an insert of sufficient length to create a wide array of compartments. A portion of this length may be allowed to remain unused in the event that few and/or small compartments are desired. In one embodiment, securing means are provided to allow for a user to attach an unused portion of the insert 14 to an internal surface of the luggage item 10 and thereby prevent the insert 14 from creating an obstruction for users and/or objects.

Figure 5:
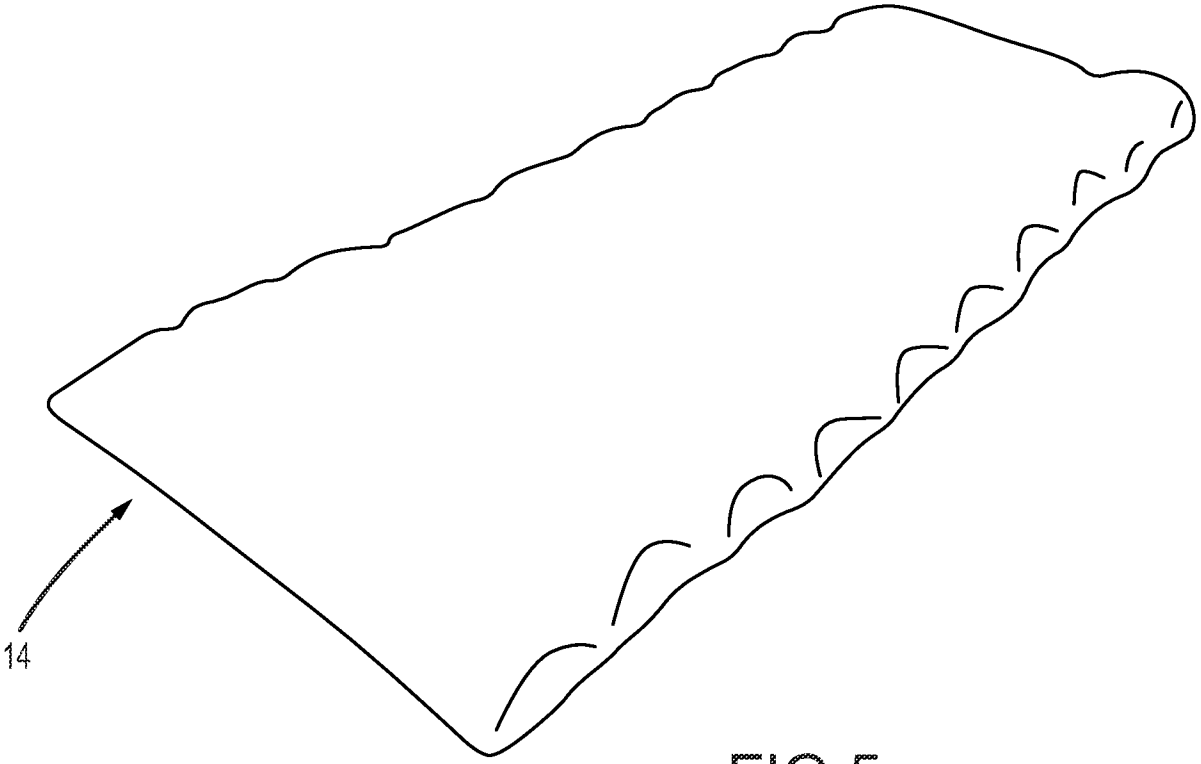
FIG. 5 is a perspective view of one embodiment of the present invention.

FIG. 5 is a perspective view of an adjustable divider 14 according to one embodiment of the present disclosure. As shown, the divider 14 comprises a substantially continuous width generally devoid of discrete sections. The divider 14 of FIG. 5 is pliable or bendable at a number of non-discrete locations. The divider 14 operates in a similar manner as dividers shown and described herein, but comprises a substantially uniform cross-section and is adapted to articulate about any number of points or locations.

Figure 6:
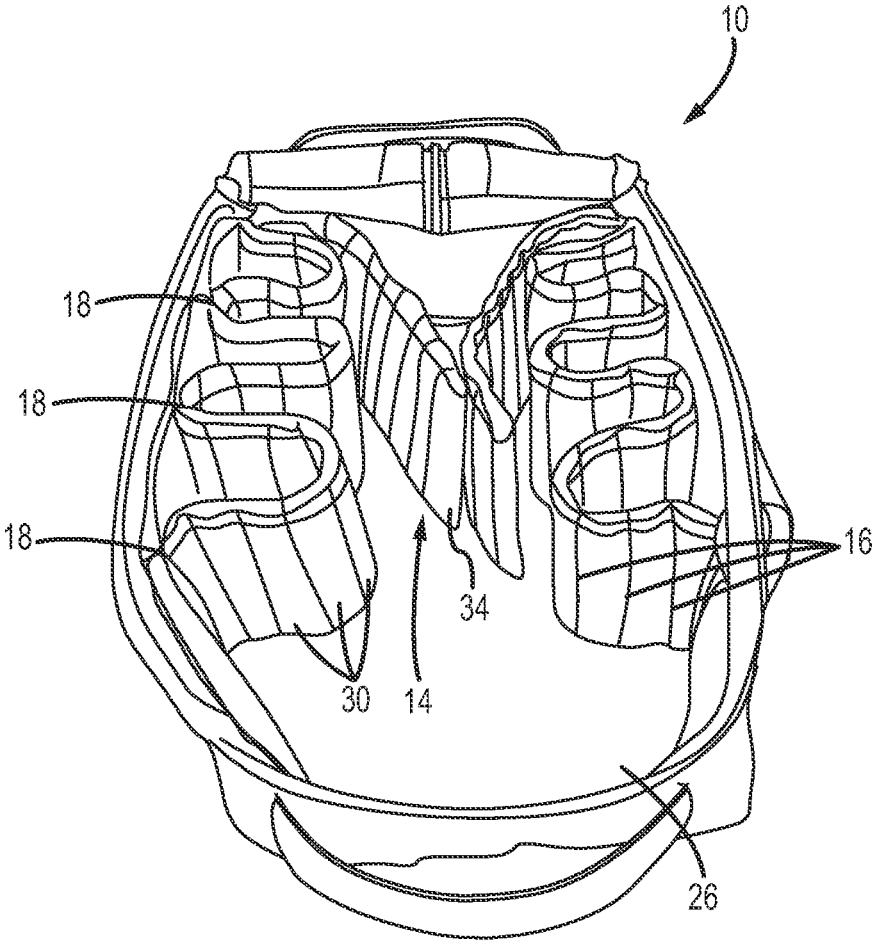
FIG. 6 is a perspective view of one embodiment of the present invention.
Figure 7:
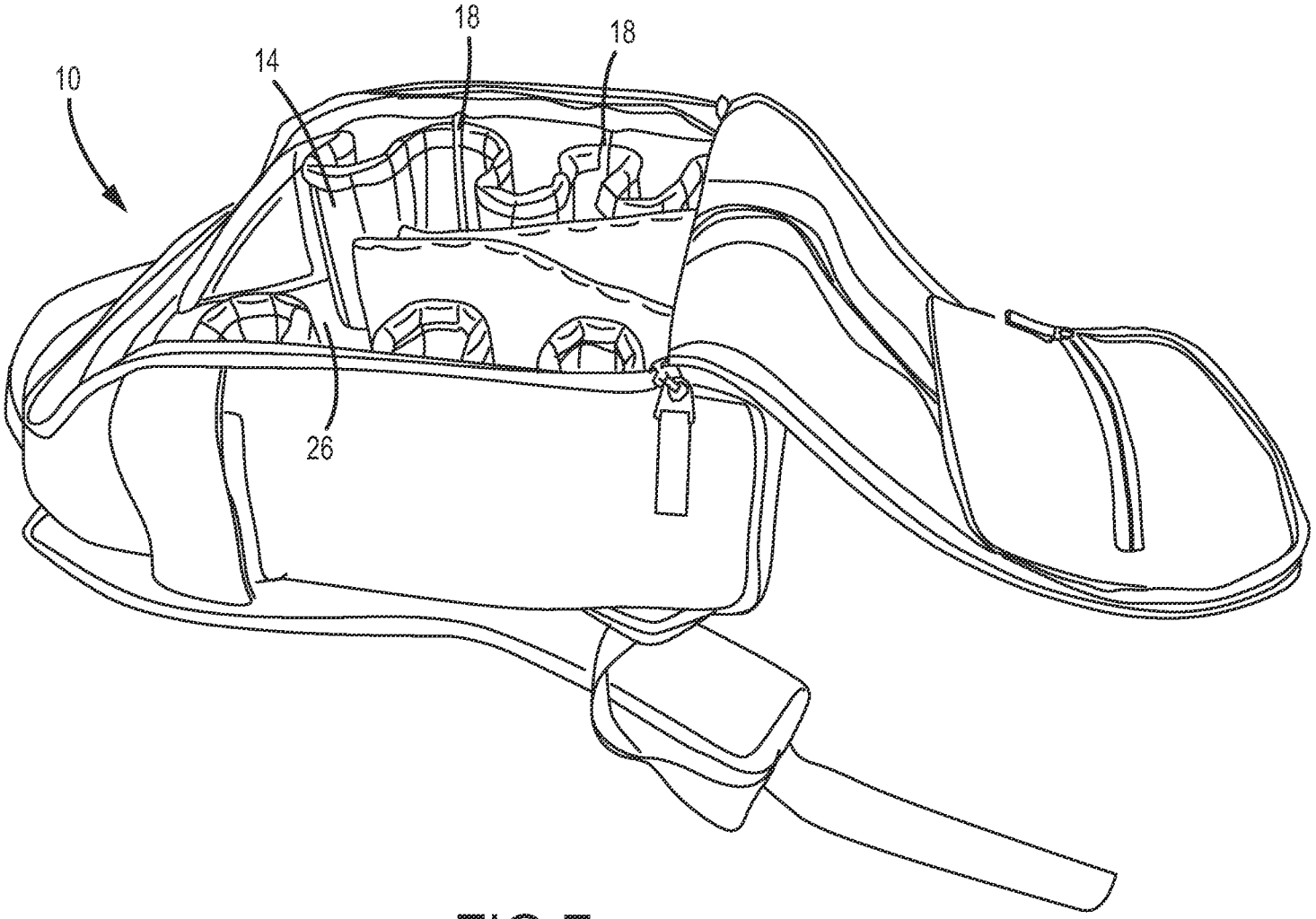
FIG. 7 is a perspective view of one embodiment of the present invention.

Referring now to FIGS. 6-7, various views of a luggage item 10 comprising an articulating insert of the present disclosure are provided. Although FIGS. 6-7 generally depict a shoulder bag or backpack suitable for transporting camera equipment, one of ordinary skill in the art will recognize that the various features and components of the present invention as shown and described herein may be disposed in or associated with any number of luggage items. Luggage items that may accommodate or utilize articulating inserts of the present disclosure include, but are not limited to, laptop cases, briefcases, attaché cases, golf bags, sport bags (e.g. those comprising compartments for water bottles), various device specific bags such as those designed to accommodate specific electronic and other sensitive devices, gun and ammunition cases, duffel bags, handbags, messenger bags, backpacks, snow, skate, or surf bags, wheeled bags, toiletry kits, diaper bags, etc.

Figure 8:
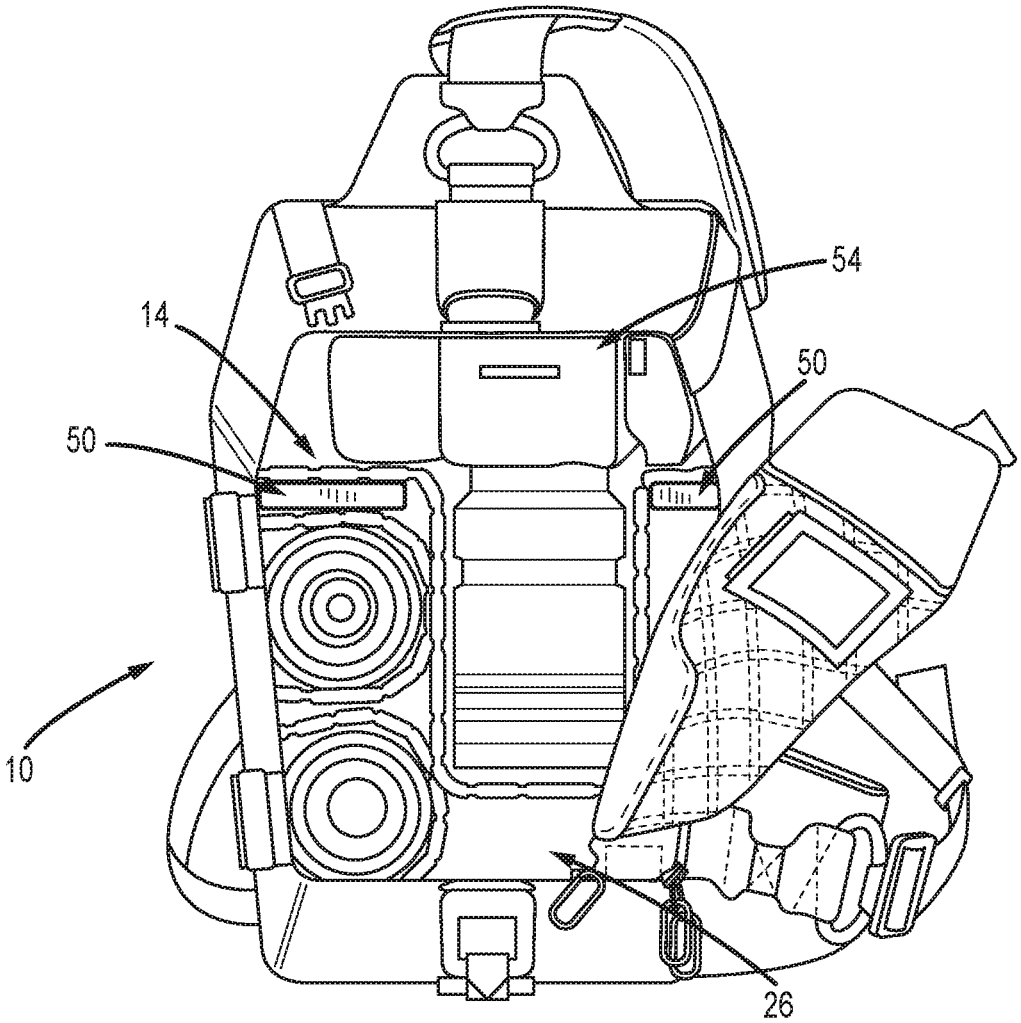
FIG. 8 is a front elevation view of one embodiment of the present invention.

FIG. 8 depicts a camera bag 10 with an articulating adjustable divider 14. In one embodiment, the bag 10 comprises an internal volume 26 with a shelf or camera cradle 50 disposed therein. The camera cradle 50 may comprise a rigid insert which is either permanently affixed within an internal volume 26 of a luggage item 10 or detachably connected to a portion of an internal volume 26 of a luggage item 10. For example, the cradle 50 may be comprised of any number of generally rigid materials, including but not limited to steel, aluminum, polycarbonates, fiberglass, titanium, polyethylene(s), wood, and other similar materials of relatively light weight and sufficient rigidity or stiffness.

As shown, the cradle 50 is generally adapted to receive and support a camera 54 or similar item with an appendage or lens extending therefrom. For example, in one embodiment, the cradle 50 comprises an aperture, recess, gap, or gate which allows for one portion of a camera 54 or other device to rest upon a main portion of the cradle 50 while another portion of the camera 54 (e.g. a lens) or similar device extends through a portion of the cradle 50.

In one embodiment, an articulating protective insert 14 is provided. As shown, the insert 14 may be employed in conjunction with the cradle 50 to further support a camera 54 and/or provide protection from impact and abrasion, particularly at sensitive areas (i.e. lenses) of the camera 54. Thus, a device, such as a camera 54, is provided within an internal volume 26 of a luggage item 10, the camera 54 being at least partially supported or segregated from additional bag components by a cradle 50 which allows for at least a portion of the camera 54 to extend therethrough. The inserted item 54 may be further bounded, protected, and/or supported through the use of an articulating divider 14 of the present invention.

In an alternative embodiment, an articulating divider 14 may be provided which is further capable of selectively sealing or closing an opening in a cradle 50, such as when a user desires to use the cradle 50 as a means to segregate and/or protect items to be stored within the luggage item 10. One of skill in the art will recognize that various components of the present invention, including, but not limited to restraining members, may be disposed at various locations on a cradle 50 of the present invention.

In one embodiment, the present invention comprises an articulating divider or insert that is capable of being fully removed from a luggage item (i.e. is not stitched, anchored, or other permanently attached to a luggage item). In this embodiment, therefore, the insert may be completely removed from the luggage item in order to create more storage space within an internal volume of the item and/or may be applied or retro-fitted to another luggage item. In one embodiment, a fully-removable insert comprises fastening features, such as Velcro, which may be attached to various portions of luggage items in which the divider is to be inserted. In another embodiment, the fully-removable articulating insert does not comprise fixtures or attachment means and is useful for protecting items by wrapping or winding around objects or residing between items in a buffer-like manner.

What is claimed is:

1. A carrying bag comprising:

an internal volume;

an insert comprising an outer portion, an inner portion, and a longitudinal length substantially greater than a lateral width;

the outer portion of the insert comprising a non-abrasive and non-rigid material;

the inner portion of the insert comprising a material adapted to absorb impact; and wherein the insert comprises a plurality of panels and wherein at least two adjacent panels are separated by a seam;

a plurality of elastic retaining members interconnected to an interior surface of said carrying bag and sized to engage the seam, wherein at least one of said plurality of elastic retaining members comprises a first end securely fixed to the carrying bag, wherein said insert may be positioned in a selected orientation to form one or more compartments which can be altered in size, wherein at least one of the elastic retaining members is operable to be received by the seam of the insert between adjacent panels and retain the insert in a desired position, and said insert can be adjusted to a plurality of shapes.

2. The carrying bag of claim 1, wherein each of the panels of the insert are connected to at least one adjacent panel by a seam, and wherein the seams allow for articulation of adjacent panels with respect to one another.

3. The carrying bag of claim 1, further comprising a substantially rigid cradle portion adapted for supporting the weight of a camera.

4. The carrying bag of claim 3, wherein at least one retaining member is secured to the substantially rigid cradle portion.

5. The carrying bag of claim 1, wherein at least one of the plurality of elastic retaining members comprises tension retaining means for securing a tension in the at least one elastic retaining member.

6. The carrying bag of claim 1, wherein the insert comprises a first end and a second end, at least one of the first end and the second end being secured to an interior portion of the carrying bag.

7. The carrying bag of claim 6, wherein at least one of the first end and the second end is secured to a substantially rigid cradle portion for receiving a camera.

8. The carrying bag of claim 1, wherein the insert is removable from the carrying bag.

9. The carrying bag of claim 1, wherein the interior surface of said carrying bag comprises a substantially rigid removable plate.

10. The carrying bag of claim 1, further comprising a substantially inelastic nylon cord adapted to secure the insert.

11. The carrying bag of claim 1, wherein the insert comprises a hook and loop closure for selectively securing the insert to a portion of an internal volume of the carrying bag.

* * * * *